US007395802B2

(12) United States Patent
Riley et al.

(10) Patent No.: US 7,395,802 B2
(45) Date of Patent: Jul. 8, 2008

(54) OIL SUPPLY FOR INTERNAL COMBUSTION ENGINE CAMSHAFT

(75) Inventors: William Riley, Livonia, MI (US); Mark Zagata, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/422,627

(22) Filed: Jun. 7, 2006

(65) Prior Publication Data

US 2007/0283920 A1 Dec. 13, 2007

(51) Int. Cl.
*F01M 1/06* (2006.01)

(52) U.S. Cl. ..... 123/196 R; 123/196 M; 123/90.12; 123/90.34

(58) Field of Classification Search ..... 123/196 R, 123/90.17, 196 M, 90.12, 90.15, 90.31, 90.34; 403/132

See application file for complete search history.

(56) References Cited

U.S. PATENT DOCUMENTS

| | | | | | |
|---|---|---|---|---|---|
| 4,258,673 | A * | 3/1981 | Stoody et al. | ..... | 123/90.34 |
| 4,306,820 | A * | 12/1981 | Nelson | ..... | 403/13 |
| 4,628,875 | A * | 12/1986 | Wells et al. | ..... | 123/90.36 |
| 4,840,149 | A * | 6/1989 | Fujita | ..... | 123/90.31 |
| 5,215,047 | A * | 6/1993 | Neutgens | ..... | 123/90.37 |
| 5,325,826 | A * | 7/1994 | Cierpial et al. | ..... | 123/90.34 |
| 5,540,197 | A * | 7/1996 | Golovatai-Schmidt et al. | ..... | 123/90.17 |
| 5,803,031 | A * | 9/1998 | Moriya | ..... | 123/90.17 |
| 6,035,817 | A * | 3/2000 | Uchida | ..... | 123/90.17 |
| 6,186,105 | B1 | 2/2001 | Yonezawa | | |
| 6,209,509 | B1 * | 4/2001 | Kammeraad et al. | .... | 123/196 R |
| 6,470,846 | B1 * | 10/2002 | Kammeraad et al. | .... | 123/196 R |
| 6,505,588 | B2 * | 1/2003 | Dietz | ..... | 123/90.17 |
| 6,675,752 | B1 | 1/2004 | Kunne et al. | | |
| 6,860,250 | B1 * | 3/2005 | Plenzler et al. | ..... | 123/196 R |
| 7,171,939 | B1 * | 2/2007 | Tiller | ..... | 123/196 R |
| 7,322,327 | B1 * | 1/2008 | Kim | ..... | 123/90.34 |
| 2003/0101949 | A1 * | 6/2003 | Uchida | ..... | 123/90.12 |
| 2005/0241607 | A1 * | 11/2005 | Lagerlof et al. | ..... | 123/196 R |
| 2006/0027198 | A1 * | 2/2006 | Plenzler et al. | ..... | 123/90.34 |
| 2006/0288976 | A1 * | 12/2006 | Watanabe | ..... | 123/196 R |
| 2007/0000470 | A1 * | 1/2007 | Lamb et al. | ..... | 123/196 R |
| 2007/0283912 | A1 * | 12/2007 | Reinhart et al. | ..... | 123/90.34 |
| 2008/0035087 | A1 * | 2/2008 | Kim et al. | ..... | 123/90.17 |

FOREIGN PATENT DOCUMENTS

| | | |
|---|---|---|
| DE | 195 02 496 | 8/1996 |
| DE | 198 16 254 | 10/1999 |
| EP | 0 918 154 | 5/1999 |
| EP | 1 046 793 | 10/2000 |
| EP | 1 249 582 | 10/2002 |

* cited by examiner

*Primary Examiner*—Hai H Huynh
(74) *Attorney, Agent, or Firm*—Diana Brehob; Dickinson Wright PLLC

(57) ABSTRACT

An oil supply system for an internal combustion engine camshaft includes an oil distribution block configured for attachment to an engine structure adjacent to and above a camshaft, with attachment of the oil distribution block occurring after the camshaft has been installed in the engine. Fixed and movable ring segments, which are mounted to the oil distribution block, cooperate to provide the camshaft with oil under pressure, which may be used for controlling auxiliary devices such as a camshaft phaser or camshaft profile switching mechanism.

11 Claims, 2 Drawing Sheets

OIL SUPPLY FOR INTERNAL COMBUSTION ENGINE CAMSHAFT

BACKGROUND OF THE INVENTION

1. Field of the Invention

The present invention relates to a system for providing either base lubrication, or additional oil to an internal combustion engine camshaft for the purpose of either lubricating the camshaft, or for controlling a device such as a camshaft timing phaser or camshaft profile switching mechanism.

2. Disclosure Information

The camshafts of reciprocating internal combustion engines are usually lubricated by means of oil brought up either through the cylinder block of the engine, as is the case of cam-in-block configurations, or with oil brought up through a cylinder head and then through the towers upon which the camshaft is mounted. The latter system generally works well, but presents an issue in the event that it is desired to build engines having non-adjustable valve timing, as well as engines having camshaft phasing, from a common supply of cylinder heads. A problem arises because if camshaft phasing is desired, it is usually necessary to provide an oil pressure signal to the camshaft phaser. This necessitates a provision such as a valve port and additional plumbing in the cylinder head to facilitate such an oil pressure signal. Unfortunately, it is an unnecessary expense to provide the basis for such valving in every engine built in a range, when only a fraction of the engines will be equipped with camshaft phasing.

The present invention allows the use of camshaft phasing with a common cylinder head having little if any additional cost built in to accommodate camshaft phasing, which in turn reduces the cost burden on engines which are not equipped with camshaft phasing.

SUMMARY OF THE INVENTION

An oil supply system for an internal combustion engine camshaft includes an oil distribution block configured for attachment to an engine structure adjacent a camshaft. At least one oil feed passage extends through the oil distribution block. A fixed ring segment is mounted to the oil distribution block. The fixed ring segment has an interior circumferential oil distribution groove in fluid communication with the oil feed passage. A movable ring segment is mounted to the oil distribution block, more specifically, to the fixed ring segment. The movable ring segment cooperates with the fixed ring segment to encircle a ported cylindrical surface of a camshaft so as to provide an interior portion of the camshaft with oil under pressure. The oil distribution block preferably has at least one solenoid valve for controlling oil flow to an auxiliary device such as a camshaft phase changer.

According to another aspect of the present invention, a method for utilizing a common cylinder head casting for a basic engine without a camshaft phaser and alternatively, an upgraded engine equipped with a camshaft phaser, includes machining a common cylinder head casting to include a mounting pad for an oil distribution block, and mounting at least one camshaft in the cylinder head casting. The method further includes mounting an oil distribution block to the mounting pad of selected engines, and installing a movable oil distribution ring segment to a fixed oil distribution ring segment incorporated in the oil distribution block such that the movable oil distribution ring and fixed oil distribution ring encircle a ported cylindrical portion of at least one camshaft so as to provide oil to a camshaft phaser mounted upon the camshaft.

According to another aspect of the present invention, a segmented oil distribution ring may either be partially incorporated in the distribution block or supported by a feed stem mounted to the distribution block, with the ring segment and feed stem being hingedly openable so as to permit installation of the segmented ring to the camshaft and to the oil distribution block after the camshaft and the oil distribution block have been mounted to a cylinder head casting.

Other advantages, as well as objects and features of the present invention will become apparent to the reader of this specification.

DETAILED DESCRIPTION OF THE PREFERRED EMBODIMENT

Figure 1:
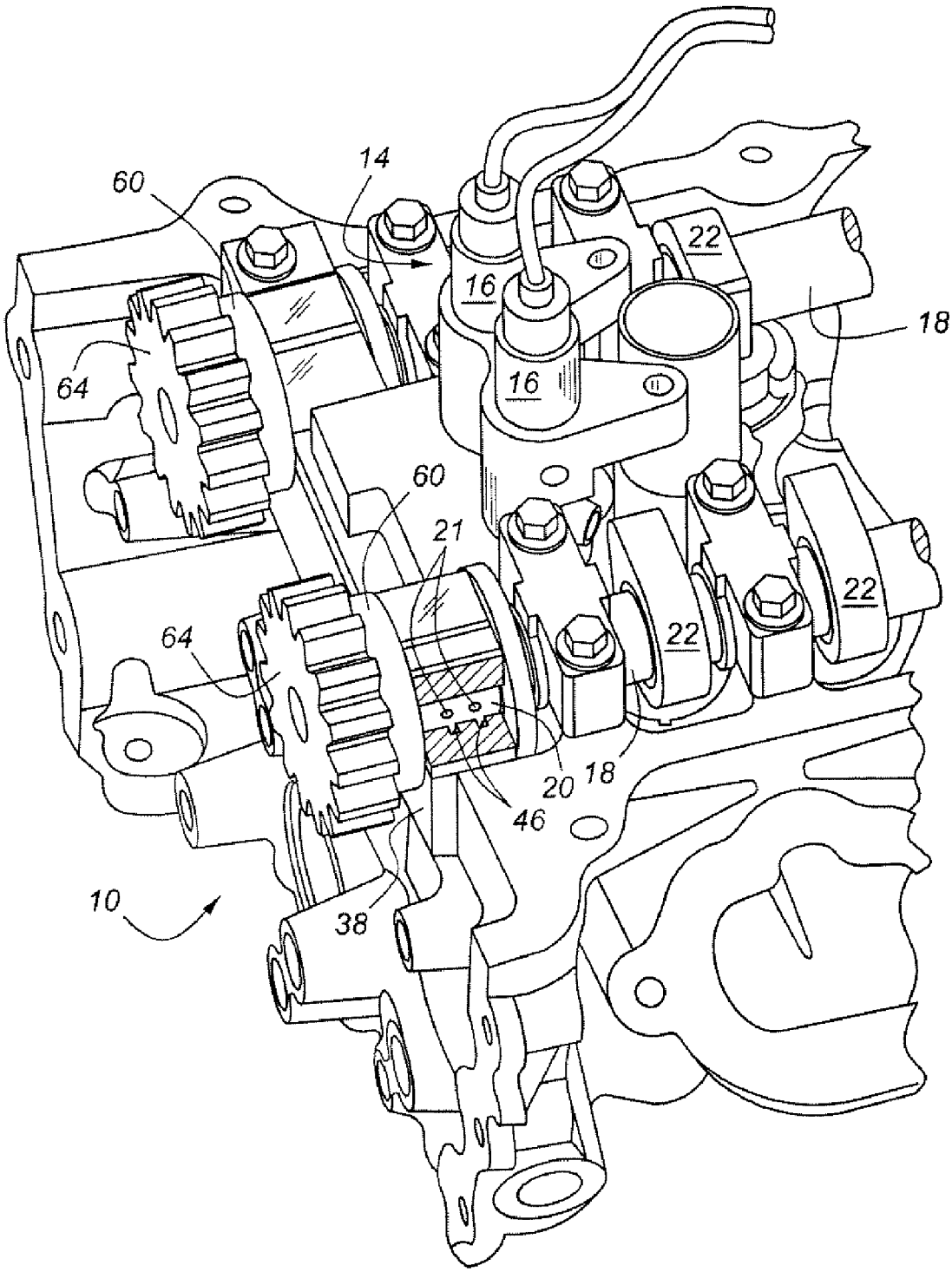
FIG. 1 is a perspective view of a cylinder head having an oil supply system according to the present invention.

As shown in FIG. 1, cylinder head 10 is equipped with oil distribution block 14, which is fastened to cylinder head 10. Oil distribution block 14 has two solenoid valves, 16, which provide oil pressure signals to camshafts 18, which have lobes 22 mounted thereupon. It should be understood from the foregoing that cylinder head 10 may be operated without camshaft phasers 60, which are shown as being driven by sprockets 64, in the event that a particular engine application does not require variable valve timing control.

The purpose of oil distribution block 14 is to provide an oil signal to phasers 60, via camshafts 18, by applying variable pressure oil at a cylindrical surface, 20, shown in FIG. 1 in cutaway. Cylindrical surface 20 has two ports 21 erupting therefrom, which are lined up with circumferential grooves 46 formed in movable ring segments 38 which are shown with particularity in FIG. 2. Oil controlled by solenoids 16 finds its way to oil feed passages 26 within oil distribution block 14. Each of passages 26 registers with one of the circumferential grooves 46 formed in a movable ring segment 38. Oil entering circumferential oil distribution grooves 46 makes its way into ports 21 formed in camshafts 18 and eventually ends up flowing axially along camshaft 18 and into one of phasers 60. The flow of oil through passages 26 is controlled by valves 16. One of passages 26 may be used for advancing camshaft timing, and the other for retarding timing. Alternatively, the passages may be used together, or in other control schemes, such as for controlling camshaft profile switching. The precise use of passages 26 is committed to those desiring to employ a system according to the present invention.

Figure 2:
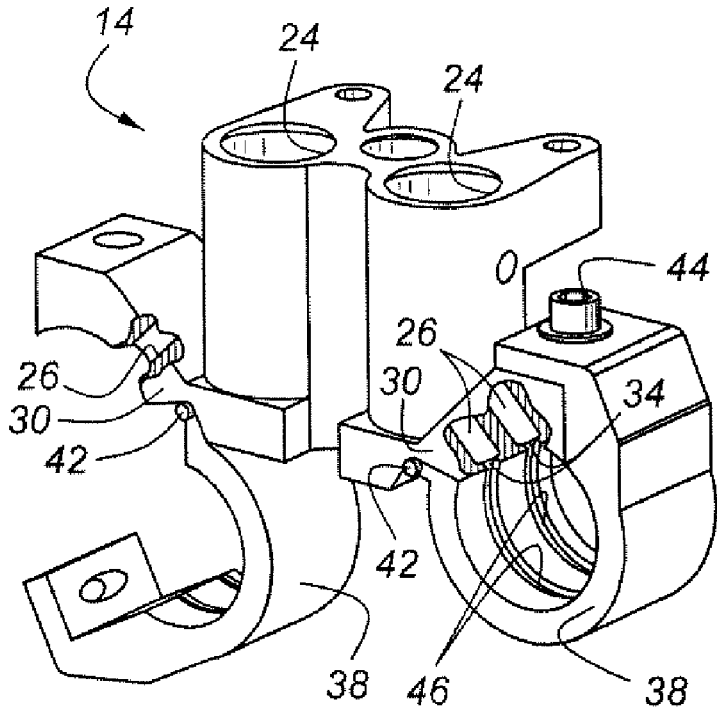
FIG. 2 is a perspective view of an oil distribution block including fixed and movable ring segments according to the present invention.

FIG. 2 illustrates a functional attribute of the present invention which allows oil distribution block 14 to be mounted to cylinder head 10 after camshafts 18 have been installed. Accordingly, movable ring segments 38 are mounted upon pivots 42 such that when fastener 44 is removed, movable ring segment 38 may be swung down so as to allow engagement of oil distribution block 14, including ring segments 38 and 30, with cylindrical surfaces 20 of camshafts 18. Then, when fastener 44 has been replaced, ring segments 30 and 38 are locked together, and oil may be directed to ports 21 formed in camshafts 18. Because only minimal expense in terms of machining is required to accommodate oil distribution block 14, within cylinder head 10, it is economically feasible to provide a single cylinder head casting, including machining for engines with and without camshaft phase control. Thus, according to the present method, it is possible to provide oil distribution blocks 14, and hence, camshaft timing control, with only selected engines, without the necessity of including costly valve hardware, or least partially cast and machined valve bodies, for all the engines within a range.

Figure 3:
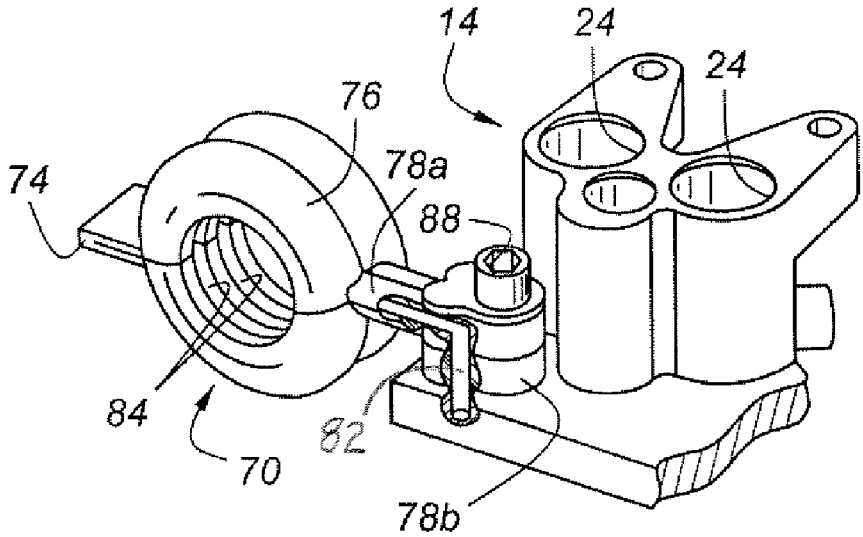
FIG. 3 is an alternative embodiment of an articulated segmented ring assembly according to another aspect of the present invention.

FIG. 3 illustrates an alternative embodiment in which an articulated segment and ring assembly 70 having a hinge, 74, is configured so that feed stem 78 and ring portion 76 may be opened by rotating about the axis of hinge 74 once fastener 88 has been removed. In this manner, articulated ring assembly 70 may be mounted to both camshaft 18 and to oil distribution block 14 by means of fastener 88, allowing oil to enter camshaft 18 by means of passage 82 and a similar passage behind passage 82 (not shown).

The fixed and movable ring segments according to the present invention may be formed from either metallic or non-metallic materials, such as plastics, or composites, or other materials known to those skilled in the art and suggested by this disclosure. The embodiment of FIG. 3 is particularly suited for rendering in a plastics material.

Although the present invention has been described in connection with particular embodiments thereof, it is to be understood that various modifications, alterations, and adaptations may be made by those skilled in the art without departing from the spirit and scope of the invention set forth in the following claims.

What is claimed is:

1. An oil supply system for an internal combustion engine camshaft, comprising:

an oil distribution block configured for attachment to an engine structure adjacent a camshaft;

an oil feed passage extending through said oil distribution block;

a fixed ring segment, mounted to said oil distribution block, with said fixed ring segment having at least one interior, circumferential oil distribution groove in fluid communication with said oil feed passage; and a movable ring segment mounted to said oil distribution block, and cooperating with said fixed ring segment to encircle a ported cylindrical surface of a camshaft, so as to provide an interior portion of a camshaft with oil under pressure, with said movable ring segment being releasable, so as to permit installation of said oil distribution block to a cylinder head casting and to a camshaft after said camshaft has been mounted in said cylinder head casting.

2. An oil supply system according to claim 1, wherein said oil distribution block is mounted to a cylinder head of an engine.

3. An oil supply system according to claim 1, wherein said movable ring segment has an interior circumferential groove in fluid communication with the interior circumferential groove formed in said fixed ring segment.

4. An oil supply system according to claim 1, wherein said movable ring segment is pivotably attached to said fixed ring segment.

5. An oil supply system according to claim 1, wherein said oil distribution block further comprises at least one valve for controlling a flow of oil through said oil feed passage and into a camshaft.

6. A cylinder head for an internal combustion engine, comprising:

a cylinder head casting having at least one camshaft mounted thereto;

a camshaft phaser mounted to said at least one camshaft;

an oil distribution block for providing a control signal to said camshaft phaser, with said oil distribution block being mounted to said cylinder head casting at a location generally above and adjacent to said camshaft; and a segmented ring attached to said oil distribution block, with said segmented ring encircling a ported, cylindrical surface of said camshaft, and with said segmented ring having a fixed ring segment receiving oil from said oil distribution block, and a movable ring segment which is releasable so as to permit installation of said oil distribution block to said cylinder head casting and to said camshaft after said camshaft has been mounted in said cylinder head casting.

7. A cylinder head according to claim 6, wherein said movable ring segment is pivotably attached to said fixed ring segment.

8. A cylinder head for an internal combustion engine, comprising:

a cylinder head casting having at least one camshaft mounted thereto;

an oil distribution block mounted to said cylinder head casting at a location generally above and adjacent said camshaft; and an articulated, segmented ring assembly attached to said oil distribution block, with said segmented ring encircling a ported, cylindrical surface of said camshaft, and with said segmented ring having a feed stem for receiving oil from said oil distribution block, and a ring segment attached to said feed stem, with said ring segment and said feed stem being hingedly openable so as to permit installation of said segmented ring to said camshaft and to said oil distribution block after said camshaft and said oil distribution block have been mounted to said cylinder head casting.

9. A cylinder head according to claim 8, wherein said segmented ring comprises a metallic casting.

10. A cylinder head according to claim 8, wherein said segmented ring is molded from plastics.

11. An oil supply system according to claim 8, said oil distribution block further comprises at least one valve for controlling a flow of oil through said oil feed passage and into said camshaft.

* * * * *